US012612772B2

(12) United States Patent
Li et al.

(10) Patent No.: US 12,612,772 B2
(45) Date of Patent: Apr. 28, 2026

(54) INTEGRATED WALL-MOUNTED BASE HAVING HANDHELD SHOWER HOLDER OF SHOWER SYSTEM AND SHOWER SYSTEM INCLUDING SAME

(71) Applicant: XIAMEN DELMEI SANITARY WARE CO., LTD., Xiamen (CN)

(72) Inventors: Wenjun Li, Nanping (CN); Pingqing Zhang, Xiamen (CN); Yongqiang Yan, Fuzhou (CN)

(73) Assignee: XIAMEN DELMEI SANITARY WARE CO., LTD., Xiamen (CN)

( * ) Notice: Subject to any disclaimer, the term of this patent is extended or adjusted under 35 U.S.C. 154(b) by 909 days.

(21) Appl. No.: 17/901,866

(22) Filed: Sep. 2, 2022

(65) Prior Publication Data

US 2023/0151594 A1 May 18, 2023

(30) Foreign Application Priority Data

Nov. 17, 2021 (CN) ..... 202122813928.X

(51) Int. Cl.
*E03C 1/04* (2006.01)
*E03C 1/02* (2006.01)

(52) U.S. Cl.
CPC ..... *E03C 1/0408* (2013.01); *E03C 1/023* (2013.01); *E03C 2001/026* (2013.01)

(58) Field of Classification Search
CPC ... E03C 1/0408; E03C 1/023; E03C 2001/026
USPC ..... 4/600
See application file for complete search history.

(56) References Cited

U.S. PATENT DOCUMENTS 6,256,808 B1 * 7/2001 Graham ..... A47K 3/28 4/615
2012/0255114 A1 * 10/2012 Reeves ..... E03C 1/0408 4/596
2019/0022671 A1 * 1/2019 Jack ..... B05B 1/18
2020/0378507 A1 * 12/2020 Jones ..... E03C 1/0408
2021/0222780 A1 * 7/2021 Wu ..... F16K 5/0442

* cited by examiner

*Primary Examiner* — Lauren A Crane

(57) ABSTRACT

An integrated wall-mounted base includes a wall-mounted base body which is provided with a water inlet connection part, a water outlet connection part, a upright column installation part, press-button switches, and a shower holder installation part. The water inlet connection part is connected to one water inlet pipe, the water outlet connection part is respectively connected to two water outlet pipes, the water inlet connection part is communicated with the water outlet connection part, and the press-button switches control opening and closing of flow passages of the two water outlet pipes. The upright column installation part is internally configured with a upright column for connecting and supporting a top shower, and an adjusting component is configured to fasten or release the upright column, as so to freely adjust a height of the upright column. The shower holder installation part is provided with a rotatable shower holder.

8 Claims, 7 Drawing Sheets

INTEGRATED WALL-MOUNTED BASE HAVING HANDHELD SHOWER HOLDER OF SHOWER SYSTEM AND SHOWER SYSTEM INCLUDING SAME

CROSS-REFERENCE TO RELATED APPLICATIONS

This application is based upon and claims priority to Chinese Patent Application No. 202122813928.X, filed on Nov. 17, 2021, the entire content of which is incorporated herein by reference.

TECHNICAL FIELD

The present disclosure relates to the technical field of shower fittings, in particular to an integrated wall-mounted base having handheld shower holder of a shower system.

BACKGROUND

Currently, most of the upper-fed shower systems divert the inlet water to the top shower and the handheld shower by a three-way joint. These systems have the following drawbacks. (1) Usually, the top shower is first assembled with the three-way joint, then mounted on the wall, meanwhile attention should be payed to align the assembly with the connection hole of the controlling handle located thereunder, thus the installation process is time-consuming and laboursome. (2) With the traditional method, the exposed connection conduits of the top shower and handheld shower have a long length, which occupies space and delivers a cumbersome look. (3) With the traditional method, switching of the shower and adjustment of the water temperature are realized by the controlling handle configured thereunder. The shower may be switched on or off by pulling out or pressing down the handle, and the water temperature may be adjusted by rotating the handle to the left or to the right. When a user wants to temporarily switch off the shower, the water temperature will be inevitably changed by the operation, which gives the user a poor using experience. Moreover, sealing ring in the controlling handle gets aged easily after being used for a long time, which would cause water leakage of the top spray or handheld shower. (4) With the traditional connection method, the height of the top shower is unadjustable and cannot meet the needs of various users. Moreover, the handheld shower holder of the existing shower system is separately mounted on the wall, which is time-consuming and laboursome for installation and occupies space.

In sum, the existing upper-fed shower systems have various drawbacks, such as limited function, unadjustable height of the top shower, etc.

SUMMARY OF THE DISCLOSURE

The present disclosure aims to address the issues of the prior art and provide an integrated wall-mounted base having handheld shower holder of a shower system.

To achieve the above objectives, the present disclosure provides the following technical solutions.

An integrated wall-mounted base having handheld shower holder of a shower system includes a wall-mounted base body, the wall-mounted base body is provided with a water inlet connection part, a water outlet connection part, a upright column installation part, press-button switches, and a shower holder installation part. The water inlet connection part is connected to one water inlet pipe, the water outlet connection part is respectively connected to two water outlet pipes, the water inlet connection part is communicated with the water outlet connection part, and the press-button switches control opening and closing of flow passages of the two water outlet pipes. The upright column installation part is internally configured with a upright column for connecting and supporting a top shower, and an adjusting component is configured to fasten or release the upright column, as so to freely adjust a height of the upright column. The shower holder installation part is provided with a rotatable shower holder.

According to some embodiments of the present disclosure, the water outlet connection part includes a water inlet cavity, and the water inlet cavity is provided with a first water splitting cavity and a second water splitting cavity which are independent and not in communication with one another. The press-button switches for controlling opening and closing of water inflow are respectively arranged in the first water splitting cavity and the second water splitting cavity, and the first water splitting cavity and the second water splitting cavity are respectively connected to one water outlet pipe, wherein a first water outlet pipe is a hose connected to an end of the upright column, and a second water outlet pipe is a hose connected to a handheld shower.

According to some embodiments of the present disclosure, the upright column installation part includes a upright column holder and the adjusting component, the upright column holder is a cylindrical structure with a channel running through the middle, and a sidewall of the cylindrical structure is provided with a screw hole communicated with the channel. The adjusting component includes a handle and a screw fixedly connected to the handle. The screw is screwed into the screw hole by rotating the handle until a screw end abuts against an outer wall of the upright column. The screw is screwed out of the screw hole by rotating the handle reversely, so as to adjust the height of the upright column.

According to some embodiments of the present disclosure, the shower holder installation part includes a base arranged on an outer sidewall of the upright column holder, a connection assembly, and a handheld shower holder. The connection assembly includes a fixing seat and a first rotary plate, the fixing seat has a first end embedded in the base and fixedly connected to an inner bottom wall of the base, and the fixing seat has a second end rotatably connected to the first rotary plate to form a serration engagement. The first rotary plate is fixedly connected to the handheld shower holder, a rotation of the handheld shower holder drives the first rotary plate to rotate relative to the fixing seat, and the serration engagement between the fixing seat and the first rotary plate delivers a feeling of gear shifting.

According to some embodiments of the present disclosure, the water inlet cavity has an opening, and the opening communicates with the water inlet connection part. The first water splitting cavity includes a first working cavity and a first water outlet cavity that communicate with each other, the first working cavity is provided with a first water inlet hole, and the first water outlet cavity is provided with a first water outlet hole connectable to the water outlet pipe. The press-button switches include a first valve cartridge and a second valve cartridge, the first valve cartridge is arranged in the first working cavity, and a first passage of the water flow is opened or closed by pressing a button of the first valve cartridge. The first passage of the water flow successively goes by the opening, the first water inlet hole, the first valve cartridge, the first water outlet cavity, the first water outlet, and the water outlet pipe. The second water splitting cavity includes a second working cavity and a second water outlet cavity that communicate with each other, the second working cavity is provided with a second water inlet hole, and the second water outlet cavity is provided with a second water outlet hole connectable to the water outlet pipe. The second valve cartridge is arranged in the second working cavity, and a second passage of the water flow is opened or closed by pressing a button of the second valve cartridge. The second passage of the water flow successively goes by the opening, the second water inlet hole, the second valve cartridge, the second water outlet cavity, the second water outlet hole, and the water outlet pipe.

According to some embodiments of the present disclosure, the fixing base includes a second rotary plate, a fixing column, and a connecting shaft. The second rotary plate has a first upper surface and a first lower surface, and the first lower surface is provided with the fixing column that is hollow inside for fitting with a fixing column on the inner bottom wall of the base by insertion. The connecting shaft is arranged at a center of the first upper surface and the first upper surface is provided with radial serrations arranged about the connecting shaft to form a first serration surface. The first rotary plate has a second upper surface and a second lower surface with an opening in the middle. The second upper surface is provided with an annular protrusion at a position opposite to the opening, and an outer sidewall of the annular protrusion is symmetrically provided with a pair of engagement blocks. The second lower surface is provided with radial serrations arranged about the middle of the second lower surface to form a second serration surface, and the annular protrusion is sleeved on the connecting shaft, such that the first serration surface and the second serration surface adjoin to each other.

According to some embodiments of the present disclosure, the second serration surface is inclined upward from an edge to the middle of the second serration surface, and an inclination angle is 1-10°.

According to some embodiments of the present disclosure, the handheld shower holder includes a holder body and an engaging ring, and the holder body includes an insertion part and a rotation connection part. The insertion part has an arc-shaped opening for holding the handheld shower, the rotation connection part has an installation cavity, the connecting shaft passes through the opening at the middle of the first rotary plate and is inserted into the installation cavity, and the engaging ring is engaged with an end portion of the connecting shaft.

According to another aspect of the present disclosure, a shower system is provided, which includes the aforementioned integrated wall-mounted base with a handheld shower holder.

The present disclosure has the following advantages. The present disclosure provides an integrated wall-mounted base for a shower system, which is convenient and quick to install, and can simultaneously or separately control the opening or closing of the handheld shower and top shower without the need to operate the control handle. Meanwhile, the height of the top shower can be adjusted freely, and the handheld shower holder is also integrated with the base, so there is no need install the handheld shower holder separately. Thus, the integrated wall-mounted base of the present disclosure is convenient to operate and can save space.

DETAILED DESCRIPTION OF THE EMBODIMENTS

Figure 1:
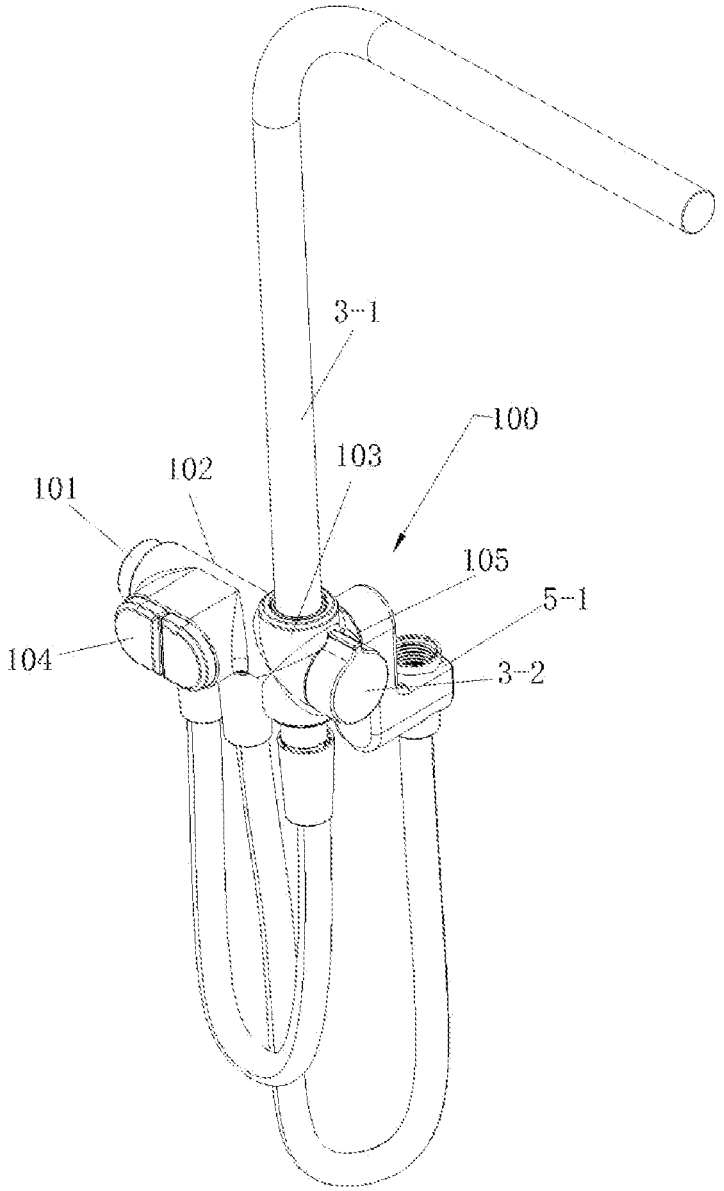
FIG. 1 is structural diagram of an integrated wall-mounted base of a shower system according to an embodiment of the present disclosure.

In order to make the objectives, technical solutions, and advantages of the embodiments of the present disclosure clearer, the technical solutions of the embodiments of the present disclosure will be described clearly and completely below with reference to the drawings of the embodiments of the present disclosure. Obviously, the described embodiments are parts of, but not all of, the embodiments of the present disclosure. Based on the embodiments of the present disclosure, all other embodiments derived by those of ordinary skills in the art without creative effort fall within the scope of protection of the present disclosure. Accordingly, the following detailed description of the embodiments of the present disclosure illustrated in the drawings is not intended to limit the scope of protection of the present disclosure, but merely to represent selected embodiments of the present disclosure. Based on the embodiments of the present disclosure, all other implementations derived by those of ordinary skill in the art without creative effort fall within the scope of the present disclosure.

In the description of the present disclosure, it should be noted that the terms of "up", "down", "inside/inner", "outside/outer", "front end", "rear end", "two ends", "one end", "another end", "one side", "another side" for indicating the location or orientation are based on the location or orientation shown in the drawings for the sake of simplifying the description of the present disclosure, rather than indicate or imply that the indicated device or component must have specific location or orientation, or be constructed and operated by specific orientation. These terms should not be understood as limits to the present disclosure. Also, the terms "first", "second" are used only for descriptive purposes and cannot be understood as indicating or implying relative importance or implying the number of indicated technical features.

In the description of the disclosure, it should be noted that, unless otherwise clearly defined and limited, the terms "provide/arrange", "connect", etc. should be understood in a broad sense, for example, "connect" may be a fixed connection, a detachable connection, or an integrated connection. Or, the connection may be a mechanical connection or an electrical connection, or may be a direct connection or an indirect connection through an intermediate medium, or may be an internal communication between two components. For those of ordinary skill in the art, the specific meaning of the above-mentioned terms in the present disclosure can be specifically understood under specific circumstances.

The details of the present disclosure will be described below in conjunction with the embodiments.

Figure 2:
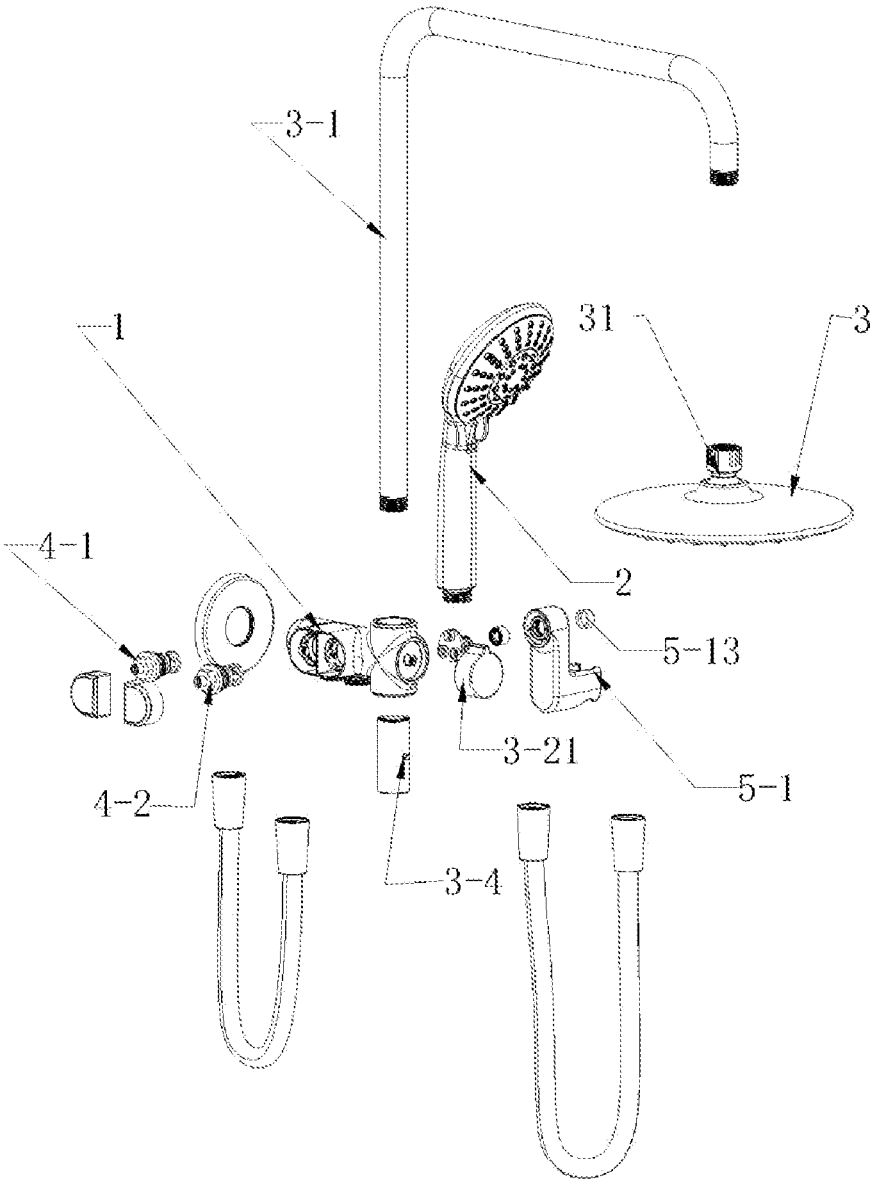
FIG. 2 is an exploded view of the integrated wall-mounted base of the shower system according to an embodiment of the present disclosure.
Figure 3:
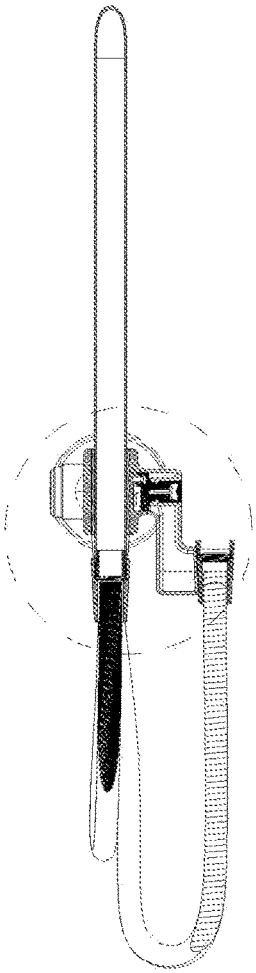
FIG. 3 is a cross section of a front view of the integrated wall-mounted base of the shower system according to an embodiment of the present disclosure.
Figure 4:
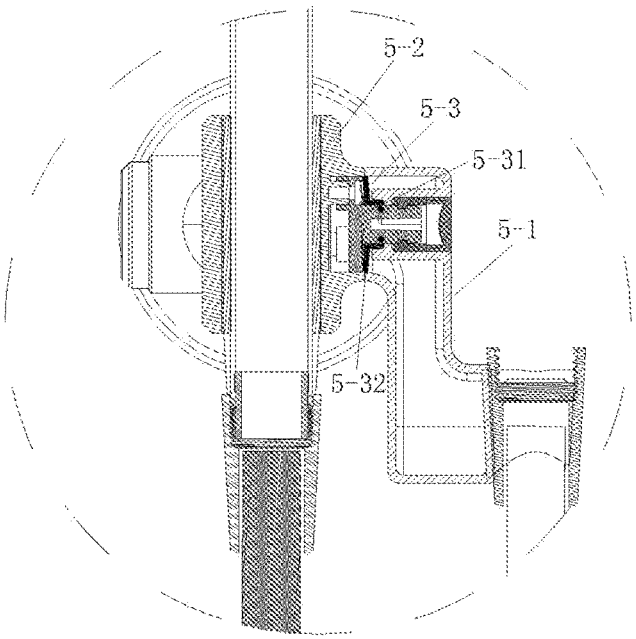
FIG. 4 is a partially enlarged view of FIG. 3.
Figure 5:
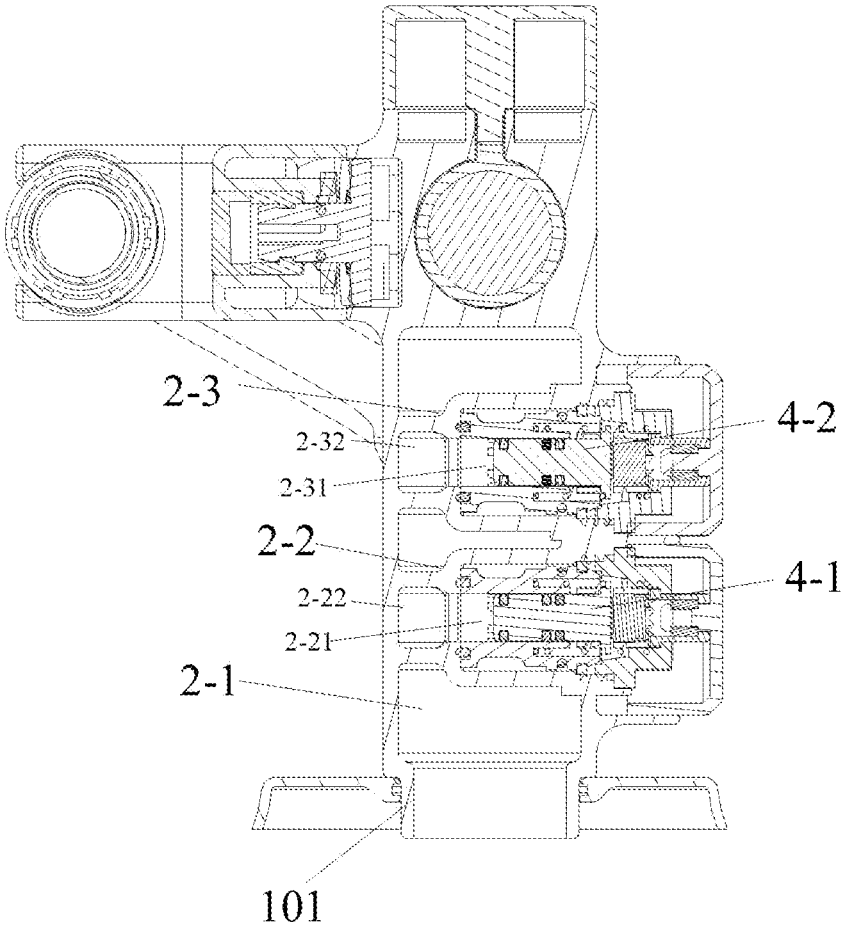
FIG. 5 is a cross section of a top view of the integrated wall-mounted base of the shower system according to an embodiment of the present disclosure.
Figure 6:
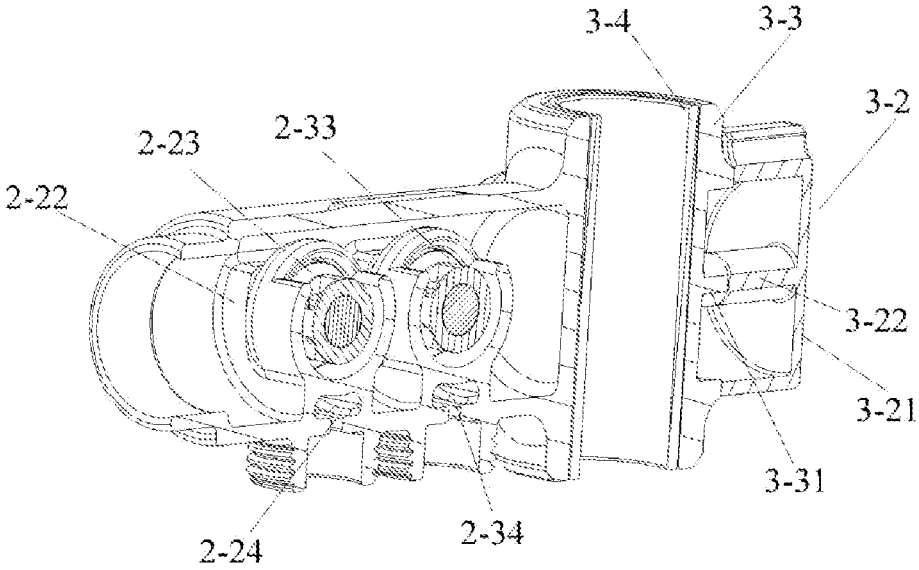
FIG. 6 is a cross section of a side view of a wall-mounted base body of the integrated wall-mounted base of the shower system according to an embodiment of the present disclosure.
Figure 7:
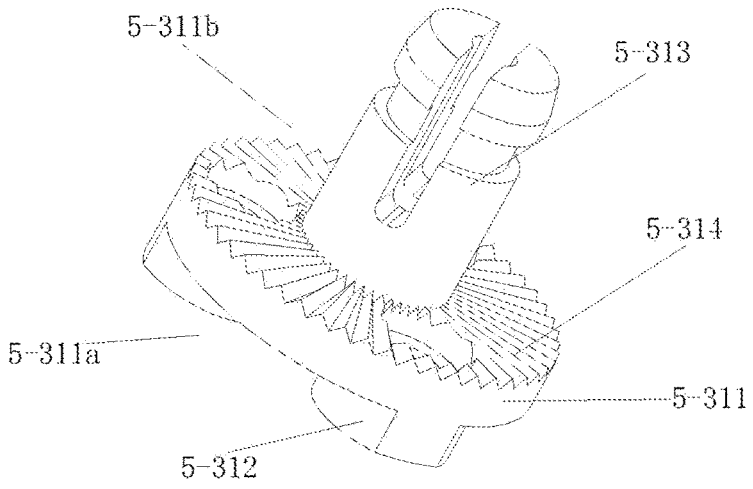
FIG. 7 is a structural diagram of a fixing seat of the integrated wall-mounted base of the shower system according to an embodiment of the present disclosure.
Figure 8:
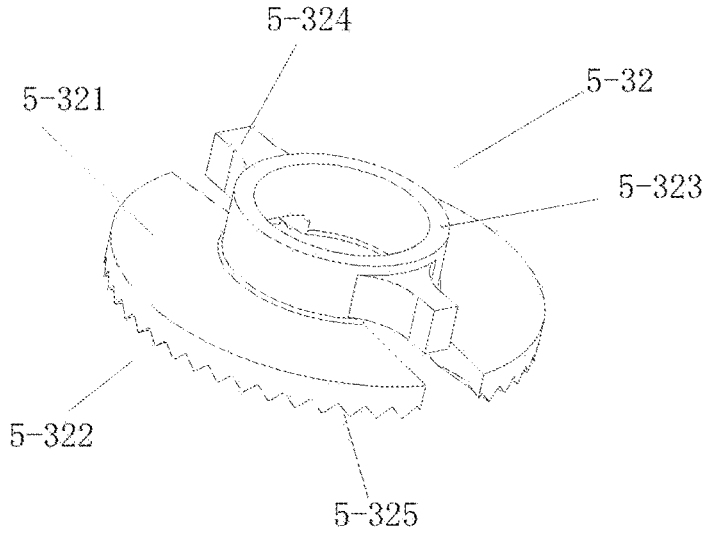
FIG. 8 is a structural diagram of a first rotary plate of the integrated wall-mounted base of the shower system according to an embodiment of the present disclosure.
Figure 9:
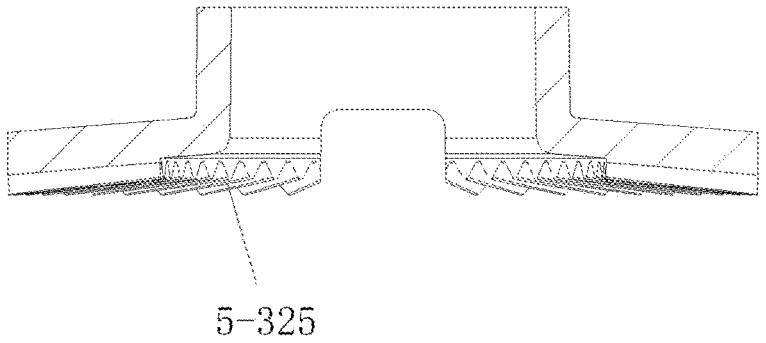
FIG. 9 is a cross-sectional view of the first rotary plate of the integrated wall-mounted base of the shower system according to an embodiment of the present disclosure.
Figure 10:
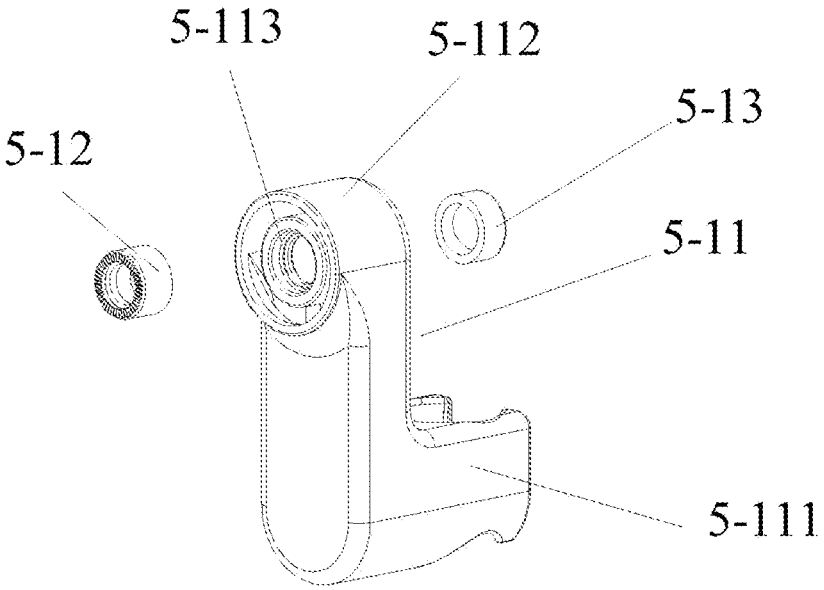
FIG. 10 is a structural diagram of a handheld shower holder of the integrated wall-mounted base of the shower system according to an embodiment of the present disclosure.
Figure 11:
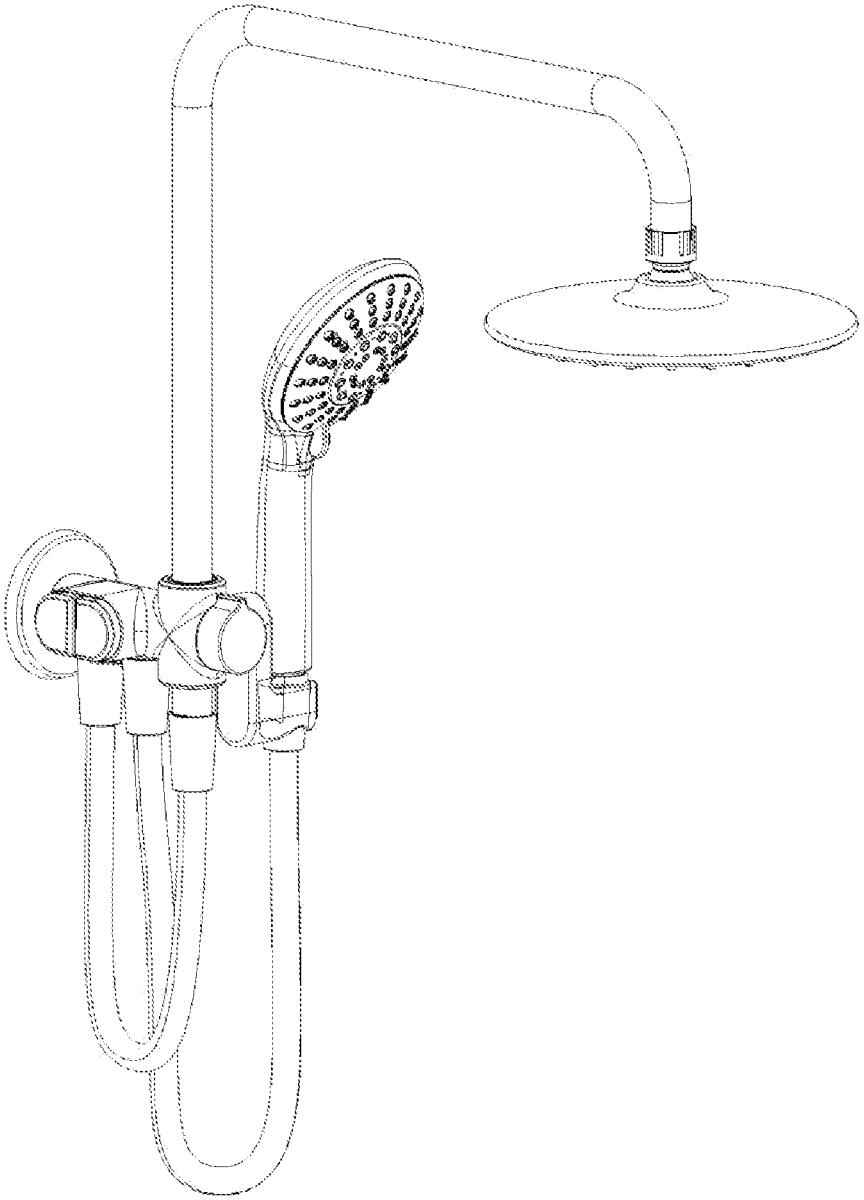
FIG. 11 is a diagram showing the overall structure of a shower system according to an embodiment of the present disclosure.

FIGS. 1-10 shows an integrated wall-mounted base having handheld shower holder of a shower system including a wall-mounted base body 100, the wall-mounted base body 100 is provided with a water inlet connection part 101, a water outlet connection part 102, a upright column installation part 103, press-button switches 104, and a shower holder installation part 105. The water inlet connection part 101 is connected to one water inlet pipe, the water outlet connection part 102 is respectively connected to two water outlet pipes, the water inlet connection part 101 is communicated with the water outlet connection part 102, and the press-button switches 104 control opening and closing of flow passages of the two water outlet pipes. The upright column installation part 103 is internally configured with a upright column 3-1 for connecting and supporting a top shower, and an adjusting component 3-2 is configured to fasten or release the upright column 3-1, as so to freely adjust a height of the upright column 3-1. The shower holder installation part 105 is provided with a rotatable shower holder 5-1.

According to some embodiments of the present disclosure, the water outlet connection part 102 includes a water inlet cavity 2-1, and the water inlet cavity 2-1 is provided with a first water splitting cavity 2-2 and a second water splitting cavity 2-3 which are independent and not in communication with one another. The press-button switches 104 for controlling opening and closing of water inflow are respectively arranged in the first water splitting cavity 2-2 and the second water splitting cavity 2-3, and the first water splitting cavity 2-2 and the second water splitting cavity 2-3 are respectively connected to one water outlet pipe, wherein a first water outlet pipe is a hose connected to an end of the upright column 3-1, and a second water outlet pipe is a hose connected to a handheld shower.

According to some embodiments of the present disclosure, the upright column installation part 103 includes a upright column holder 3-3 and the adjusting component 3-2, the upright column holder 3-3 is a cylindrical structure with a channel running through the middle, and a sidewall of the cylindrical structure is provided with a screw hole 3-31 communicated with the channel. The adjusting component 3-2 includes a handle 3-21 and a screw 3-22 fixedly connected to the handle 3-21. The screw 3-22 is screwed into the screw hole 3-31 by rotating the handle 3-21 until a screw end abuts against an outer wall of the upright column 3-1. The screw 3-22 is screwed out of the screw hole 3-31 by rotating the handle 3-21 reversely, so as to adjust the height of the upright column 3-1. According to some implementations of the present disclosure, the upright column 3-1 is externally sleeved with a sleeve tube 3-4, and a outer sidewall of the sleeve tube 3-4 is provided with a protrusion at a position corresponding to the screw hole 3-31. Rotating the handle 3-21, the screw 3-22 is screwed into the screw hole 3-31, until the screw end abuts against the protrusion, such that the upright column 3-1 is fastened with the sleeve tube 3-4.

According to some embodiments of the present disclosure, the shower holder installation part 105 includes a base 5-2 arranged on an outer sidewall of the upright column holder 3-3, a connection assembly 5-3, and a handheld shower holder 5-1. The connection assembly 5-3 includes a fixing seat 5-31 and a first rotary plate 5-3. The fixing seat 5-31 has a first end embedded in the base 5-2 and fixedly connected to an inner bottom wall of the base 5-2, and the fixing seat 5-31 has a second end rotatably connected to the first rotary plate 5-32 to form a serration engagement. The first rotary plate 5-32 is fixedly connected to the handheld shower holder 5-1, a rotation of the handheld shower holder 5-1 drives the first rotary plate 5-32 to rotate relative to the fixing seat 5-31, and the serration engagement between the fixing seat 5-31 and the first rotary plate 5-32 delivers a feeling of gear shifting.

According to some embodiments of the present disclosure, the water inlet cavity 2-1 has an opening, and the opening communicates with the water inlet connection part 101. The first water splitting cavity 2-2 includes a first working cavity 2-21 and a first water outlet cavity 2-22 that communicate with each other. The first working cavity 2-21 is provided with a first water inlet hole 2-23, and the first water outlet cavity 2-22 is provided with a first water outlet hole 2-24 connectable to the water outlet pipe. The press-button switches 104 include a first valve cartridge 4-1 and a second valve cartridge 4-2, the first valve cartridge 4-1 is arranged in the first working cavity 2-21, and a first passage of the water flow is opened or closed by pressing a button of the first valve cartridge 4-1. The first passage of the water flow successively goes by the opening, the first water inlet hole 2-23, the first valve cartridge 4-1, the first water outlet cavity 2-22, the first water outlet 2-24, and the water outlet pipe. The second water splitting cavity 2-3 includes a second working cavity 2-31 and a second water outlet cavity 2-32 that communicate with each other, the second working cavity 2-31 is provided with a second water inlet hole 2-33, and the second water outlet cavity 2-32 is provided with a second water outlet hole 2-34 connectable to the water outlet pipe. The second valve cartridge 4-2 is arranged in the second working cavity 2-31, and a second passage of the water flow is opened or closed by pressing a button of the second valve cartridge 4-2. The second passage of the water flow successively goes by the opening, the second water inlet hole 2-33, the second valve cartridge 4-2, the second water outlet cavity 2-32, the second water outlet hole 2-34, and the water outlet pipe. The first valve cartridge 4-1 and the second valve cartridge 4-2 are press-type switching valves which may have a working principle similar to the pressing structure of a retractable ballpoint pen. The press-type switching valves can independently control the opening and closing of the water inlet of respective water splitting cavity, so as to simultaneously or separately open or close the top shower and the handheld shower. Compared with the traditional method which does not allow simultaneous opening of the top shower and the handheld shower, the structure of the present disclosure not only allows to temporarily turn off the shower without changing the previously set water temperature, but also allow to control the shower in multiple ways. Moreover, when water leakage is caused due to the failure of the main control structure, the integrated wall-mounted base of the present disclosure can be used as a backup switch to turn off the shower. Thus, the service life is prolonged while the user experience is improved. Further, the first water outlet hole 2-24 and/or the second water outlet hole 2-34 is connected to the upright column 3-1 configured on the same body through a hose, which greatly shortens the length of the connecting pipeline of the top shower, so the structure is more compact.

According to some embodiments of the present disclosure, the fixing base 5-31 includes a second rotary plate 5-311, a fixing column 5-312, and a connecting shaft 5-313. The second rotary plate 5-311 has a first upper surface 5-311*a* and a first lower surface 5-311*b*, and the first lower surface 5-311*b* is provided with the fixing column 5-312 that is hollow inside for fitting with a fixing column on the inner bottom wall of the base 5-2 by insertion. The connecting shaft 5-313 is arranged at a center of the first upper surface 5-311*a* and the first upper surface 5-311*a* is provided with radial serrations arranged about the connecting shaft 5-313 to form a first serration surface 5-314. The first rotary plate 5-32 has a second upper surface 5-321 and a second lower surface 5-322 with an opening in the middle. The second upper surface 5-321 is provided with an annular protrusion 5-323 at a position opposite to the opening, and an outer sidewall of the annular protrusion 5-323 is symmetrically provided with a pair of engagement blocks 5-324. The second lower surface 5-322 is provided with radial serrations arranged about the middle of the second lower surface 5-322 to form a second serration surface 5-325, and the annular protrusion 5-323 is sleeved on the connecting shaft 5-313, such that the first serration surface 5-314 and the second serration surface 5-325 adjoin to each other. In some embodiments, the plate is provided with openings at positions right under the engagement blocks 5-324. The second serration surface 5-325 is inclined upward from an edge to the middle of the second serration surface 5-325, and an angle between the inclined surface and a horizontal surface is defined as an inclination angle. The inclination angle may range 1-10°. Preferably, the inclination angle is 5-8°. According to the above embodiments, the handheld shower holder has a serration engagement which delivers a feeling of gear shifting, and the second serration surface 5-325 is slightly inclined upward from the edge to the middle, so as to reduce the operation resistance and allow the holder to rotate smoothly. Compared with the traditional handheld shower holder, the present disclosure improves the feeling of rotating the holder.

According to some embodiments of the present disclosure, the handheld shower holder 5-1 includes a holder body 5-11 and an engaging ring 5-12, and the holder body 5-11 includes an insertion part 5-111 and a rotation connection part 5-112. The insertion part 5-111 has an arc-shaped opening for holding the handheld shower, the rotation connection part 5-112 has an installation cavity 5-113, the connecting shaft 5-313 passes through the opening at the middle of the first rotary plate 5-32 and is inserted into the installation cavity 5-113, and the engaging ring 5-12 is engaged with an end portion of the connecting shaft 5-313. The engaging ring 5-12 may be a hollow cylindrical structure having an end surface provided with serrations and another end surface matched with a decorative cover 5-13.

According to another aspect of the present disclosure, a shower system is provided, which includes the aforementioned integrated wall-mounted base 1 with handheld shower holder, a handheld shower 2, and a top shower 3. The integrated wall-mounted base 1 is connected to two water outlet pipes, a first water outlet pipe is connected to the handheld shower 2, a second water outlet pipe is connected to an end of the upright column 3-1, and the top end of the upright column 3-1 is connected to the top shower 3. The top surface of the top shower 3 is provided with a universal ball head 31 which can freely adjust the spray angle of the top shower.

Working principle: according to the present disclosure, the passage of water flow is switched on or off by pressing the buttons of the valve cartridges, the water outlet holes are connected to the handheld shower and the upright column connected to the top shower by flexible hoses, and the height of the upright column can be adjusted by fastening or releasing the screw. Switching the passage of water flow by press buttons is simple and reliable, and height adjustment of the upright column by screw is also very simple. The handheld shower holder is integrated on the base body, and the shower holder is rotatable which can adjust orientation while providing a feeling of gear shifting, thus providing a comfortable operation experience. Compared with the traditional three-way valve, the proposed structure has a substantially different operation mode, and the upright column having elbow tube part provides increased comfort.

The implementations in the above-mentioned embodiments may be further combined or made minor substitutions, and the embodiments merely describe preferred implementations of the present disclosure, and do not limit the concept and scope of the present disclosure. Without departing from the design concept of the present disclosure, the various changes and improvements made to the technical solution of the present disclosure by those of ordinary skill in the art should be considered as falling within the scope of the present disclosure.

What is claimed is:

1. An integrated wall-mounted base having a handheld shower holder of a shower system, comprising: a wall-mounted base body;

wherein the wall-mounted base body is provided with a water inlet connection part, a water outlet connection part, an upright column installation part, press-button switches, and a shower holder installation part;

the water inlet connection part is connected to one water inlet pipe, the water outlet connection part is respectively connected to two water outlet pipes, the water inlet connection part is communicated with the water outlet connection part, and the press-button switches control opening and closing of flow passages of the two water outlet pipes;

the upright column installation part is internally configured with an upright column for connecting and supporting a top shower, and an adjusting component is configured to fasten or release the upright column, as so to freely adjust a height of the upright column; and the shower holder installation part is rotatably connected with the handheld shower holder;

wherein, the water outlet connection part comprises a water inlet cavity, and the water inlet cavity is provided with a first water splitting cavity and a second water splitting cavity which are independent and not in communication with one another;

the press-button switches for controlling opening and closing of water inflow are respectively arranged in the first water splitting cavity and the second water splitting cavity; and the first water splitting cavity and the second water splitting cavity are respectively connected to one water outlet pipe, a first water outlet pipe is a hose connected to an end of the upright column, and a second water outlet pipe is a hose connected to a handheld shower.

2. The integrated wall-mounted base having handheld shower holder of a shower system according to claim 1, wherein the upright column installation part comprises an upright column holder and the adjusting component, the upright column holder is a cylindrical structure with a channel running through the middle, and a sidewall of the cylindrical structure is provided with a screw hole communicated with the channel; and the adjusting component comprises a handle and a screw fixedly connected to the handle, the screw is screwed into the screw hole by rotating the handle until a screw end abuts against an outer wall of the upright column, and the screw is screwed out of the screw hole by rotating the handle reversely, so as to adjust the height of the upright column.

3. The integrated wall-mounted base having handheld shower holder of a shower system according to claim 2, wherein the shower holder installation part comprises a base arranged on an outer sidewall of the upright column holder, a connection assembly, and the handheld shower holder;

the connection assembly comprises a fixing seat and a first rotary plate, the fixing seat has a first end embedded in the base and fixedly connected to an inner bottom wall of the base, and the fixing seat has a second end rotatably connected to the first rotary plate to form a serration engagement, the first rotary plate is fixedly connected to the handheld shower holder, a rotation of the handheld shower holder drives the first rotary plate to rotate relative to the fixing seat, and the serration engagement between the fixing seat and the first rotary plate delivers a feeling of gear shifting.

4. The integrated wall-mounted base having handheld shower holder of a shower system according to claim 3, wherein the water inlet cavity has an opening, and the opening communicates with the water inlet connection part;

the first water splitting cavity comprises a first working cavity and a first water outlet cavity that communicate with each other, the first working cavity is provided with a first water inlet hole, and the first water outlet cavity is provided with a first water outlet hole connectable to the water outlet pipe, the press-button switches comprises a first valve cartridge and a second valve cartridge, the first valve cartridge is arranged in the first working cavity, and a first passage of the water flow is opened or closed by pressing a button of the first valve cartridge, the first passage of the water flow successively goes by the opening, the first water inlet hole, the first valve cartridge, the first water outlet cavity, the first water outlet, and the water outlet pipe; and the second water splitting cavity comprises a second working cavity and a second water outlet cavity that communicate with each other, the second working cavity is provided with a second water inlet hole, and the second water outlet cavity is provided with a second water outlet hole connectable to the water outlet pipe, the second valve cartridge is arranged in the second working cavity, and a second passage of the water flow is opened or closed by pressing a button of the second valve cartridge, the second passage of the water flow successively goes by the opening, the second water inlet hole, the second valve cartridge, the second water outlet cavity, the second water outlet hole, and the water outlet pipe.

5. The integrated wall-mounted base having handheld shower holder of a shower system according to claim 3, wherein the fixing base comprises a second rotary plate, a fixing column, and a connecting shaft;

the second rotary plate has a first upper surface and a first lower surface, and the first lower surface is provided with the fixing column that is hollow inside for fitting with a fixing column on the inner bottom wall of the base by insertion, the connecting shaft is arranged at a center of the first upper surface and the first upper surface is provided with radial serrations arranged about the connecting shaft to form a first serration surface; and the first rotary plate has a second upper surface and a second lower surface with an opening in the middle, the second upper surface is provided with an annular protrusion at a position opposite to the opening, and an outer sidewall of the annular protrusion is symmetrically provided with a pair of engagement blocks, the second lower surface is provided with radial serrations arranged about the middle of the second lower surface to form a second serration surface, and the annular protrusion is sleeved on the connecting shaft, such that the first serration surface and the second serration surface adjoin to each other.

6. The integrated wall-mounted base having handheld shower holder of a shower system according to claim 5, wherein the second serration surface is inclined upward from an edge to the middle of the second serration surface, and an inclination angle is 1-10°.

7. The integrated wall-mounted base having handheld shower holder of a shower system according to claim 5, wherein the handheld shower holder comprises a holder body and an engaging ring;

the holder body comprises an insertion part and a rotation connection part, the insertion part has an arc-shaped opening for holding the handheld shower, the rotation connection part has an installation cavity, the connecting shaft passes through the opening at the middle of the first rotary plate and is inserted into the installation cavity, and the engaging ring is engaged with an end portion of the connecting shaft.

8. A shower system, comprising an integrated wall-mounted base having a handheld shower holder, wherein the integrated wall-mounted base comprises a wall-mounted base body, the wall-mounted base body is provided with a water inlet connection part, a water outlet connection part, an upright column installation part, press-button switches, and a shower holder installation part;

the water inlet connection part is connected to one water inlet pipe, the water outlet connection part is respectively connected to two water outlet pipes, the water inlet connection part is communicated with the water outlet connection part, and the press-button switches control opening and closing of flow passages of the two water outlet pipes;

the upright column installation part is internally configured with an upright column for connecting and supporting a top shower, and an adjusting component is configured to fasten or release the upright column, as so to freely adjust a height of the upright column; and the shower holder installation part is rotatably connected with the handheld shower holder;

wherein, the water outlet connection part comprises a water inlet cavity, and the water inlet cavity is provided with a first water splitting cavity and a second water splitting cavity which are independent and not in communication with one another;

the press-button switches for controlling opening and closing of water inflow are respectively arranged in the first water splitting cavity and the second water splitting cavity; and the first water splitting cavity and the second water splitting cavity are respectively connected to one water outlet pipe, a first water outlet pipe is a hose connected to an end of the upright column, and a second water outlet pipe is a hose connected to a handheld shower.

* * * * *